US008844448B2

(12) United States Patent
Allen et al.

(10) Patent No.: US 8,844,448 B2
(45) Date of Patent: Sep. 30, 2014

(54) NECK HARNESS SLING HAND FREE REVERSIBLE DESK

(71) Applicants: Lester Samuel Allen, Miami, FL (US); Lester Celestino Allen, Miami, FL (US)

(72) Inventors: Lester Samuel Allen, Miami, FL (US); Lester Celestino Allen, Miami, FL (US)

( * ) Notice: Subject to any disclaimer, the term of this patent is extended or adjusted under 35 U.S.C. 154(b) by 0 days.

(21) Appl. No.: 14/105,818

(22) Filed: Dec. 13, 2013

(65) Prior Publication Data

US 2014/0216306 A1 Aug. 7, 2014

(51) Int. Cl.
*A47B 23/00* (2006.01)

(52) U.S. Cl.
USPC ..... 108/43; 224/930

(58) Field of Classification Search
CPC ..... A47B 23/002; A47G 23/0608; A45F 2003/002; A45F 5/00
USPC ..... 108/13, 42–43; 224/201, 600, 197, 224/607–608, 614, 616–619, 621, 623, 930
See application file for complete search history.

(56) References Cited

U.S. PATENT DOCUMENTS 1,542,163 A * 6/1925 Morde ..... 224/646
3,090,330 A * 5/1963 Best ..... 108/43
4,887,752 A * 12/1989 Nauta ..... 224/621
5,186,375 A * 2/1993 Plonk ..... 224/623
5,551,615 A * 9/1996 McIntosh ..... 224/270
5,724,225 A * 3/1998 Hrusoff et al. ..... 361/679.55
5,762,250 A * 6/1998 Carlton et al. ..... 224/579
5,887,777 A * 3/1999 Myles et al. ..... 224/578
5,938,096 A * 8/1999 Sauer et al. ..... 224/625
6,381,127 B1 * 4/2002 Maddali et al. ..... 361/679.55
6,936,791 B1 * 8/2005 Baldwin et al. ..... 219/387
7,191,926 B1 * 3/2007 Costantino et al. ..... 224/605
7,778,026 B2 * 8/2010 Mitchell ..... 361/679.55
7,780,049 B1 * 8/2010 Baranoski ..... 224/250
8,032,949 B1 * 10/2011 Matthews ..... 2/94
8,109,421 B2 * 2/2012 McLean et al. ..... 224/270
8,657,248 B2 * 2/2014 Rowzee et al. ..... 248/444
2003/0160078 A1 * 8/2003 Godshaw et al. ..... 224/607
2005/0150432 A1 * 7/2005 Wen ..... 108/38
2005/0189388 A1 * 9/2005 Godshaw et al. ..... 224/607
2006/0092141 A1 * 5/2006 Amani et al. ..... 345/173
2007/0051766 A1 * 3/2007 Spencer ..... 224/607
2010/0038393 A1 * 2/2010 Zhang ..... 224/600
2012/0217852 A1 * 8/2012 Yu ..... 312/223.1
2012/0308164 A1 * 12/2012 Hudson ..... 383/98

* cited by examiner

*Primary Examiner* — Hanh V Tran
(74) *Attorney, Agent, or Firm* — Oakwood Law Group, LLP; Stephen Liu

(57) ABSTRACT

A device relates generally to a portable support plane, and more particularly to a neck harness sling that goes on a user's neck and suspends a rectangular reversible plane that provides a hands free, stable surface that supports portable electronic devices including but not limited to tablets and smartphones, or legal pads about a user's neck for convenient writing, typing or texting while walking, sitting, standing or reclining.

10 Claims, 9 Drawing Sheets

NECK HARNESS SLING HAND FREE REVERSIBLE DESK

REFERENCE TO RELATED APPLICATIONS

This patent application claims the benefit of U.S. Provisional Application No. 61/849,900 filed on Feb. 5, 2013, the disclosure of which is incorporated herein by reference in its entirety.

BACKGROUND OF THE INVENTION

1. Field of the Invention

The present invention relates generally to a portable support plane, and more particularly to a neck harness sling from about a user's neck suspending a rectangular reversible plane that provides a hands free, stable surface supporting electronic devices including but not limited to tablets and smartphones or legal pads about a user's neck for convenient writing, typing or texting while walking, sitting, standing or reclining.

2. Description of Related Art

Most suppliers of cases for electronic equipment do not sell or market portable table-like support systems that the user may use to write, type, or text.

Therefore, it is desirable to have a portable table-like support system that can support the mobile devices or legal pads without using hands and thus can free the hands to do something else for example, writing, typing or texting while walking, sitting, standing or reclining. Moreover, it is desirable to have the table-like support system to allow the user to adjust the angle of the tablet or smartphone or legal pad to the user's liking.

SUMMARY OF THE INVENTION

The present invention is directed to a device that provides features overcoming many of the deficiencies of the prior art.

In an exemplary embodiment of the present invention, there is disclosed a device which is a neck harness sling suspending a rectangular reversible plane that provides a hands free, stable surface which can support electronic devices including a tablet, smartphone or legal pad about a user's neck for convenient writing, typing or texting while walking, sitting, standing or reclining.

The device 100 comprises a supporting plane which is suspended by two triangular shaped slings which are then attached to a belt that can be hung around a user's neck and disposed in front of the user front. Each of the triangular shaped slings is formed by (1) a string, (2) two string hooks connected to the supporting plane and (3) a swivel hook attached to the belt.

The special design of the cords and swivel hooks enables the supporting plane to be tilted or rotated 180 degrees more or less from a vertical position to a horizontal position in order to conveniently suit for the position that the users take. The device is easy to carry when the supporting plane is in a stowed vertical position with the plane parallel with the belt. The device has retainers on the supporting plane to secure the mobile devices or legal pad on top of the device to prevent the mobile device from inadvertent falling. The device further has a plurality of clips attached to the underneath of the supporting plane to hold the legal pad when the legal pad is not in use.

The more important features of the invention have thus been outlined in order that the more detailed description that follows may be better understood and in order that the present contribution to the art may better be appreciated. Additional features of the invention will be described hereinafter and will form the subject matter of the claims that follow.

Before explaining at least one embodiment of the invention in detail, it is to be understood that the invention is not limited in its application to the details of construction and the arrangements of the components set forth in the following description or illustrated in the drawings. The invention is capable of other embodiments and of being practiced and carried out in various ways. Also it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

The foregoing has outlined, rather broadly, the preferred feature of the present invention so that those skilled in the art may better understand the detailed description of the invention that follows. Additional features of the invention will be described hereinafter that form the subject of the claims of the invention. Those skilled in the art should appreciate that they can readily use the disclosed conception and specific embodiment as a basis for designing or modifying other structures for carrying out the same purposes of the present invention and that such other structures do not depart from the spirit and scope of the invention in its broadest form.

BRIEF DESCRIPTION OF THE DRAWINGS

Other aspects, features, and advantages of the present invention will become more fully apparent from the following detailed description, the appended claim, and the accompanying drawings in which similar elements are given similar reference numerals.

DESCRIPTION OF THE PREFERRED EMBODIMENT

Figure 1A:
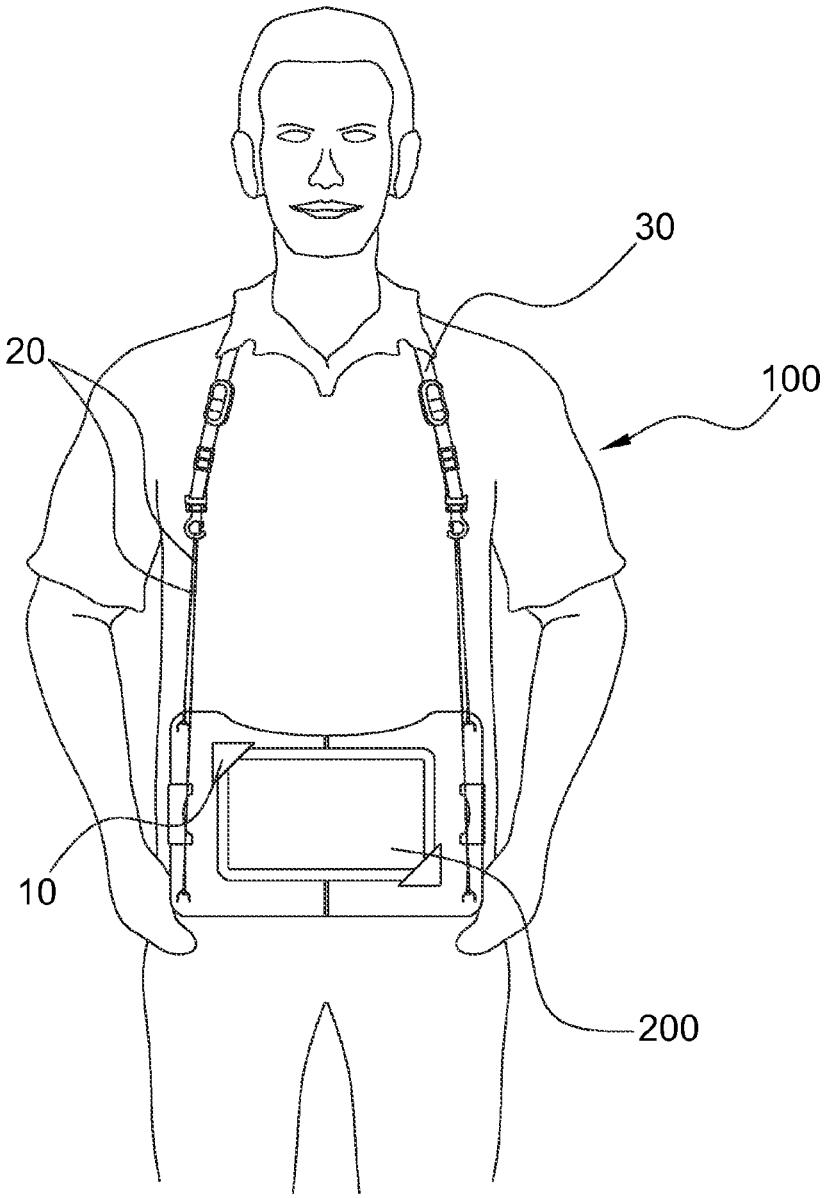
FIG. 1A is a perspective front view of the device in accordance with the present invention hung in front of a user with the reversible plane in a vertical position with a mobile device thereon.

Referring to FIGS. 1A, 1B, 2, 3, 4, 5, 6, 7, and 8, there is disclosed a neck harness sling attached to a hands free reversible desk 100 in accordance with the present invention.

The device 100 comprises a supporting plane 10 which is attached to a belt through cords 20. The belt 30 and cords 20 together enable a user to type, write, and text using the plane 10 as a desk without needing to hold the plane, mobile device or legal pad.

Figure 1B:
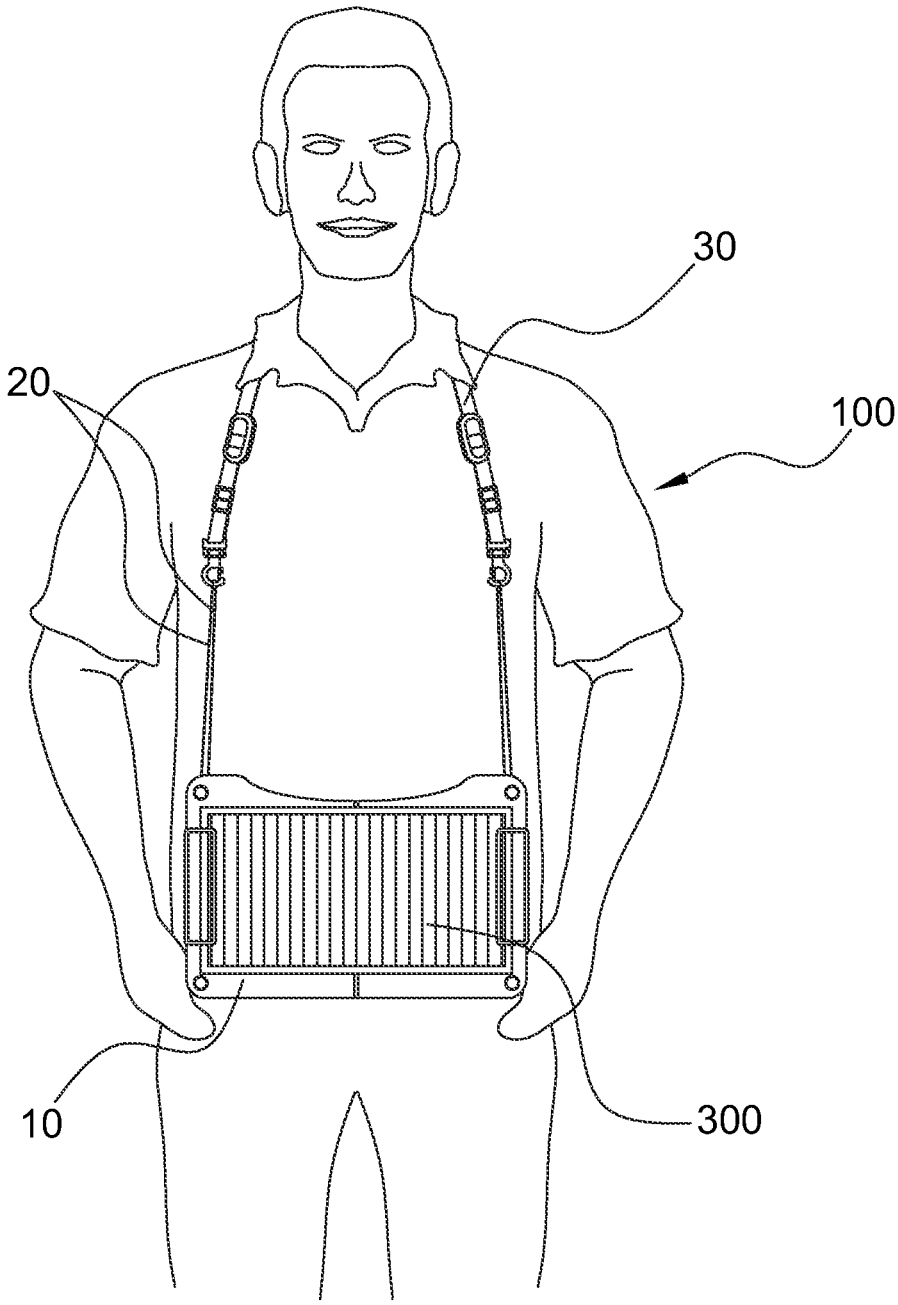
FIG. 1B is a perspective front view of the device in accordance with the present invention hung in front of a user with the reversible plane in a vertical position with a legal pad thereon.

FIG. 1A and FIG. 1B are perspective front views of the device 100 in accordance with the present invention hung in front of a user where the reversible supporting plane 10 is held by cords 20 and indirectly attached to the belt 30. In these figures, the supporting plane 10 is held in a vertical position. A mobile device 200 such as a tablet is retained on the supporting plane in FIG. 1A and a legal pad 300 is retained on the supporting plane in FIG. 1B.

Figure 2:
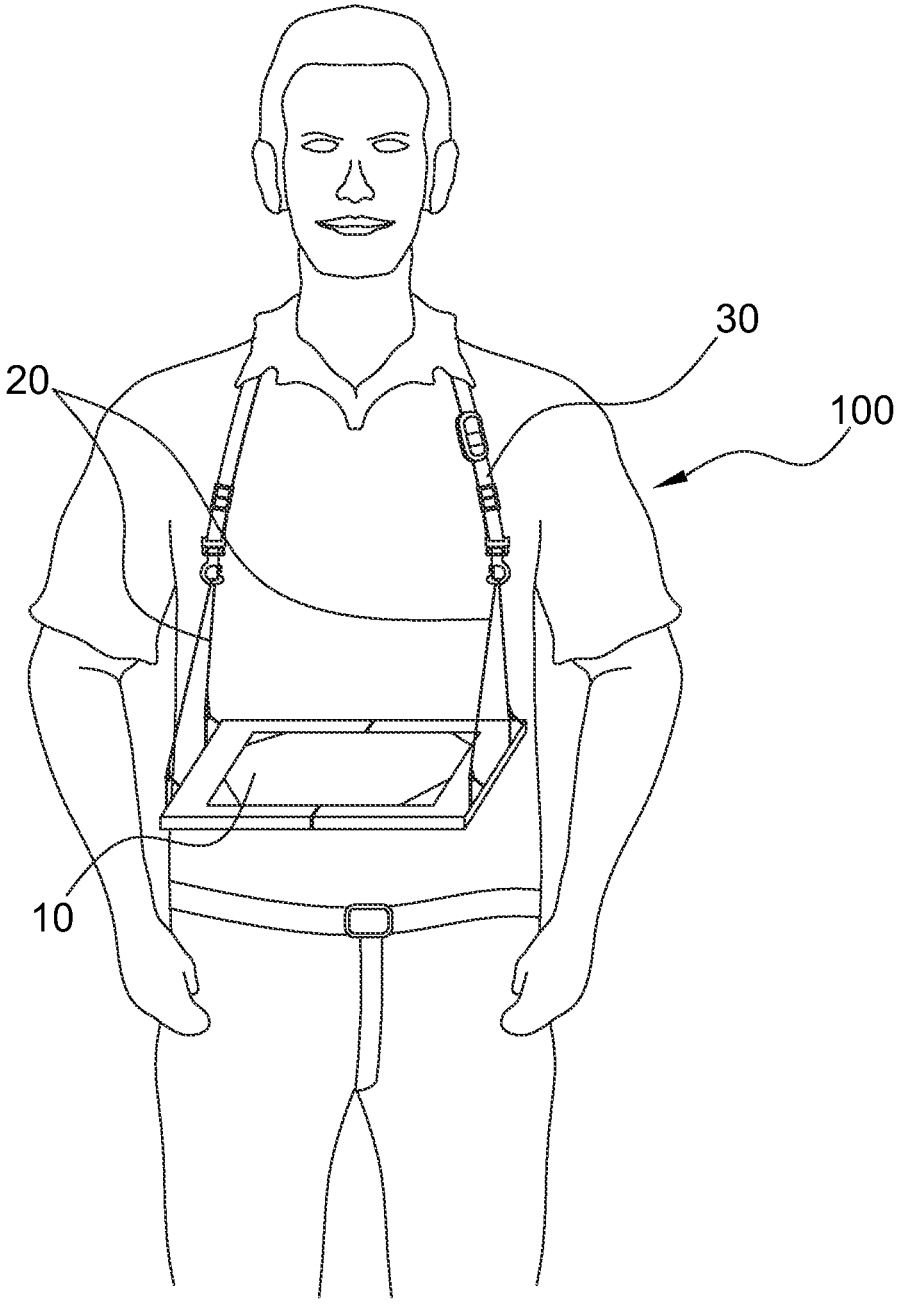
FIG. 2 is a perspective front view of the device in accordance with the present invention hung in front of a user with the reversible plane in a horizontal position.

FIG. 2 is a perspective front view of the device 100 hung in front of a user where the reversible plane 10 is held in a horizontal position by the cords 20 and belt 30. It is obvious that the plane 10 can support a mobile device or legal pad without needing a user to hold the plane or the mobile device or legal pad so that the user can free hand to type, write or text.

Figure 3:
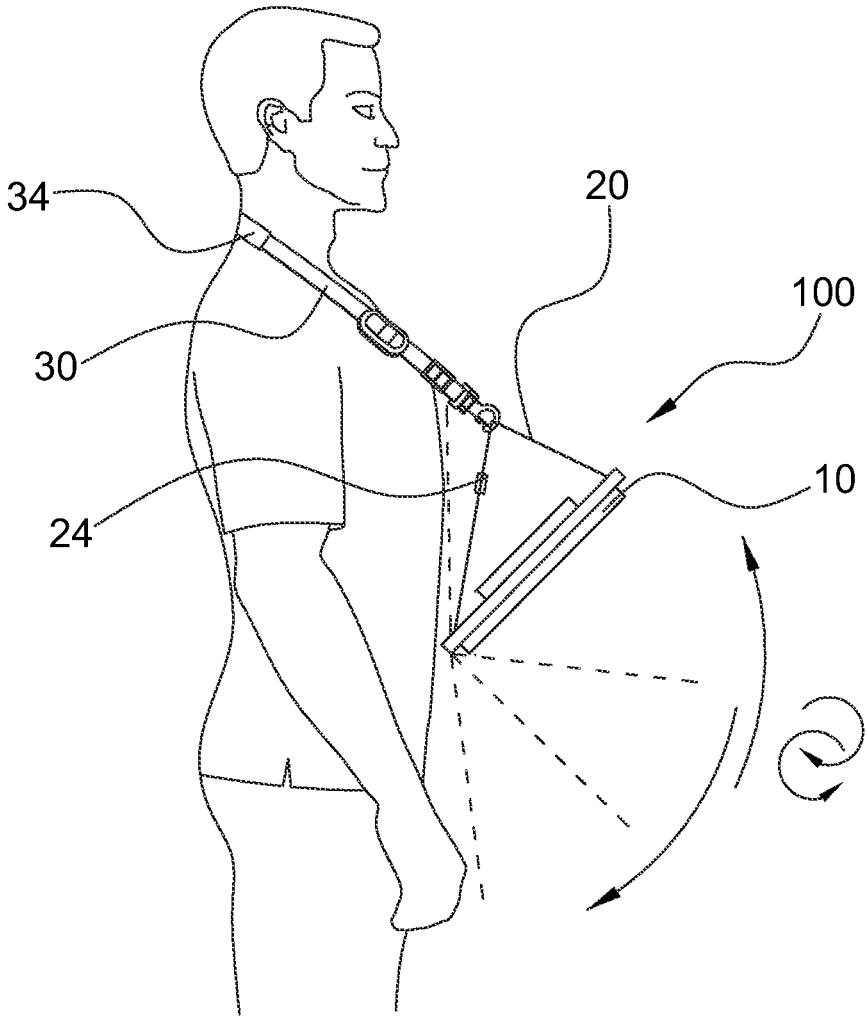
FIG. 3 is a perspective side view of the device in accordance with the present invention hung in front of a user showing that the reversible plane can be rotated (tilted) 180 degrees.

FIG. 3 is a perspective side view of the device 100 hung over a user's neck in front of a user showing that the supporting plane 10 held by cords 20 can be rotated 180 degrees more or less relative to the belt 30.

Figure 4:
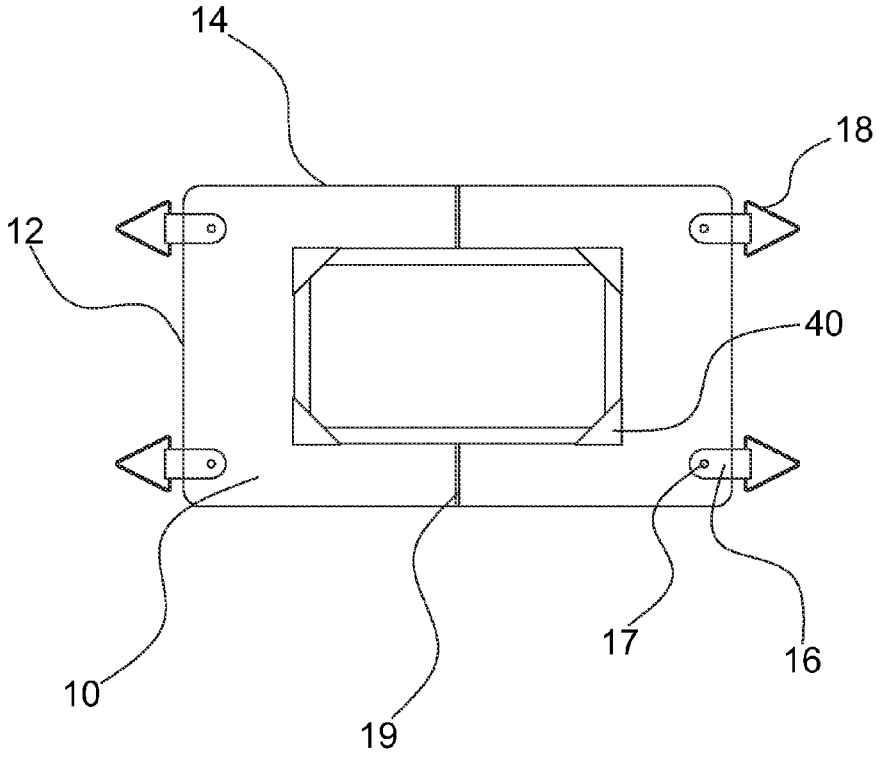
FIG. 4 is a close-up top view of the supporting plane of the device in accordance with the present invention where the rectangular plane is made of two halves which are unfolded and connected to each other flush.

FIG. 4 is a close-up top view of the supporting plane 10 according to the principles of the invention. The supporting plane 10 of the device 100 in this embodiment is in a rectangular shape. It has two short sides 12, two long sides 14 and four small pieces of fabric 16 each of which is permanently connected to one of the two ends of the two short sides via rivets 17. In this figure, the supporting rectangular plane 10 is detached from the cords 20.

The device further comprises four string hooks 18 each of which is removably attached to one piece of the fabric or leather 16. (FIG. 4)

Figure 5:
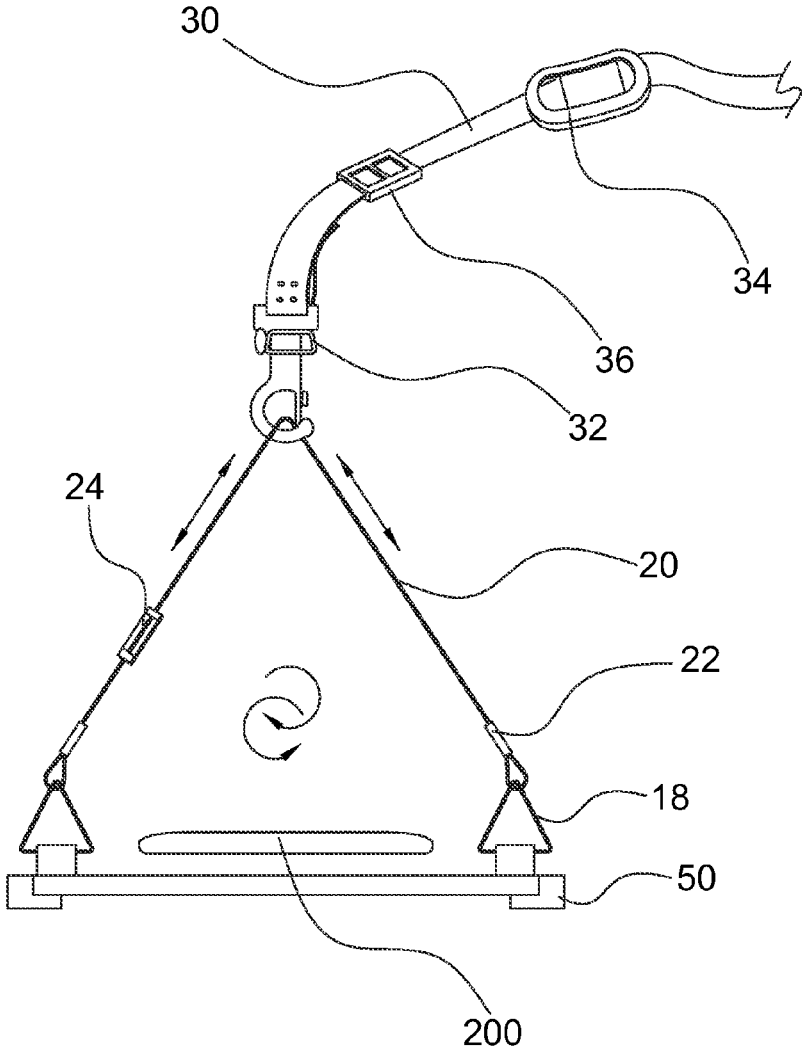
FIG. 5 is a close-up side view of the cords and belt of the device in accordance with the present invention showing the triangle sling formed by a cord, a swivel hook, two string hooks and a supporting plane as well as the belt connected to the swivel hook.

FIG. 5 is a close-up view of the cord 20 and belt 30 according to the principles of the invention. In this embodiment, the device 100 comprises a pair of cords 20, each of which has two ends respectively connected to a clamp 22 through which each cord 20 can be removably attached to the two string hooks 18 which are located on the same short side 12 of the rectangular plane.

The belt 30 of the device has two ends respectively connected to two swivel hooks 32.

Each of the pair of cords 20 can be removably attached to one of the swivel hooks 32 so that the rectangular plane 10 can rotate (or tilt) 180 degrees more or less relative to the belt 30 from a vertical stowed position to a horizontal position in order to conveniently suit for the position that the users take as illustrated in FIG. 3. A swivel hook 32 together with the cord 20 and two string hooks 18 form one triangular sling. Two triangular slings suspend the rectangular supporting plane to work as a portable desk. The device 100 further comprises a component 24 attached to the belt to prevent the supporting plane 10 from tilting forward out of orientation. Such component 24 may be a ferrule or any component known in the art. The mechanism for the component 24 to prevent the supporting plane 10 from tilting forward and out of orientation is clearly shown in FIG. 3.

The device 100 further comprises at least one neck pad 34 which is locked onto the belt around the user's neck area to make the user comfortable when wearing the device 100. The length of the belt 100 can be adjusted using an adjuster 36 attached to the belt 30 so that the height of the rectangular plane 10 can be adjusted to be conveniently suitable for the position that the users take. The neck pad 34 is located around the user's neck as shown in FIG. 3.

The device 100 further comprises a plurality of clips 40 under the supporting plane 10 for holding the legal pad when the legal pad is not in use.

Figure 6:
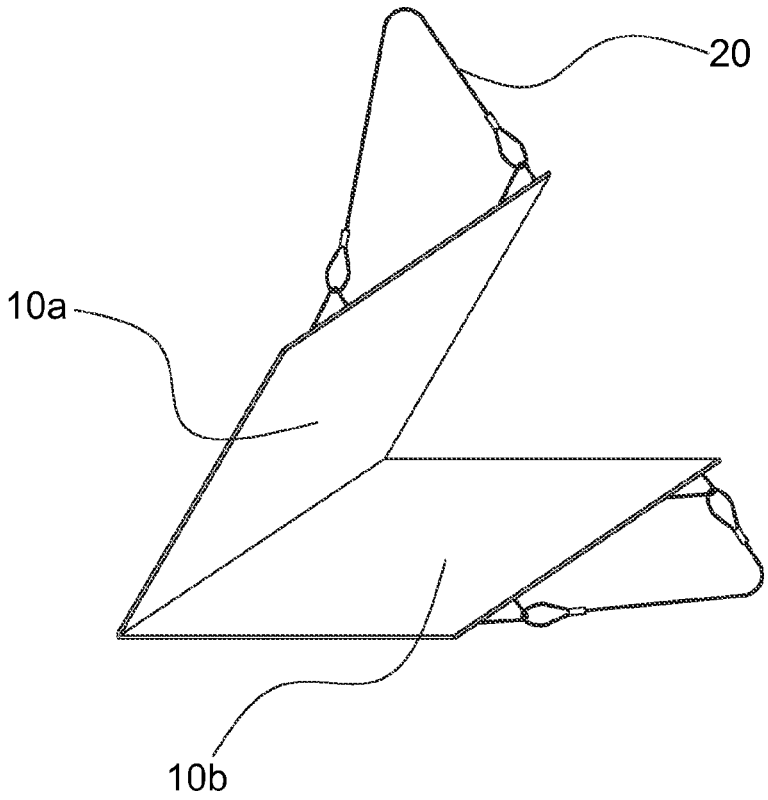
FIG. 6 is an isometric view of the supporting plane of a neck harness sling hands free reversible desk in accordance with the present invention showing that the two halves of the rectangular plane is foldable.

In one embodiment, the rectangular plane 10 is made of two halves 10*a* and 10*b* which are connected to each other via a hinge 19 running parallel with the short sides 11 of the rectangular plane 10 as shown in FIG. 6. The two halves 10*a* and 10*b* are foldable upon each other. The portable desk is flat when the foldable halves of the rectangular plane are opened. It is unfolded when in use in order to provide larger supporting surface and may be folded when in a stowed position in order to reduce the size for easy carrying.

In another embodiment, the rectangular plane 10 is one single unit and cannot be folded.

The cords 20 can be either attached to or detached from the rectangular plane 10. The cords 20 can be attached to or detached from the swivel hooks 32 on the belt 30. For convenience, the cords 20 are usually attached to the rectangular plane 10 when the device 100 is not in use.

FIG. 6 is an isometric view showing the two halves 10*a* and 10*b* of the rectangular supporting plane 10 are foldable.

Figure 7:
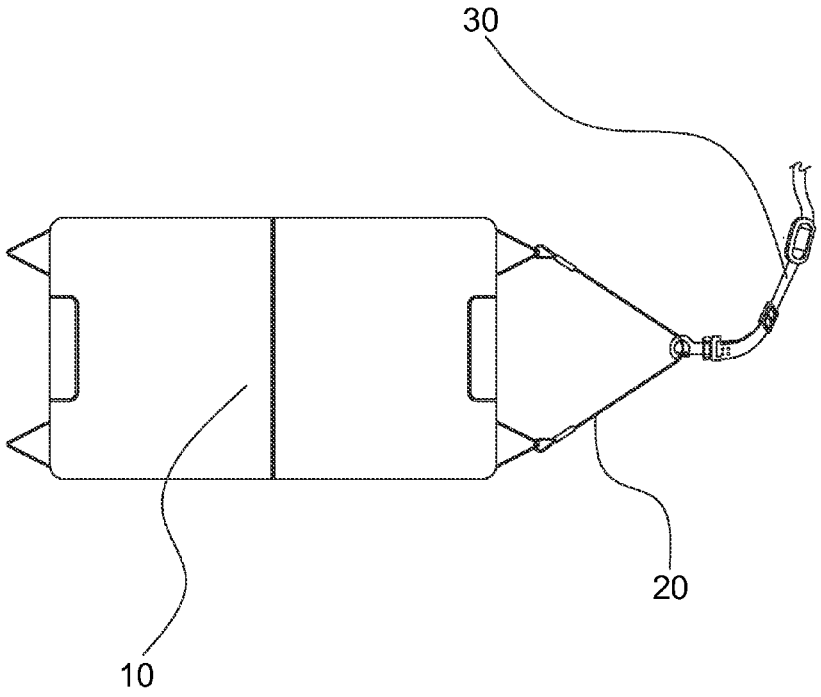
FIG. 7 is a top view of the supporting plane attached to a cord and then a belt.

FIG. 7 is a top view of the supporting plane 10 attached to one cord 20 and belt 30.

Figure 8:
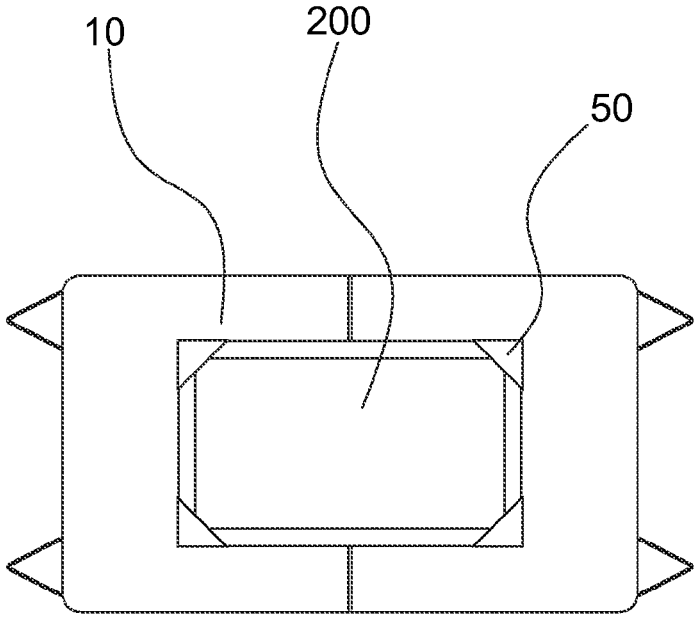
FIG. 8 is a top view of the supporting plane with a tablet on the plane and fastened by the retainers on the supporting plane.

FIG. 8 is a top view of the supporting plane 10 with tablets 200 such as an ipad on the plane and fastened by the retainers 50 on the supporting plane 10.

While there have been shown and described and pointed out the fundamental novel features of the invention as applied to the preferred embodiments, it will be understood that the foregoing is considered as illustrative only of the principles of the invention and not intended to be exhaustive or to limit the invention to the precise forms disclosed. Obvious modifications or variations are possible in light of the above teachings. The embodiments discussed were chosen and described to provide the best illustration of the principles of the invention and its practical application to enable one of ordinary skill in the art to utilize the invention in various embodiments and with various modifications as are suited to the particular use contemplated All such modifications and variations are within the scope of the invention as determined by the appended claims when interpreted in accordance with the breadth to which they are entitled.

What is claimed is:

1. A device offering a portable, stable and reversible plane for supporting a mobile device or legal pad and allowing a user to type or write on said mobile device or legal pad or perform other tasks, the device comprising:

a supporting plane which has two short sides, two long sides, and four string hooks, each of which is removably connected to one of two ends of the two short sides;

a pair of cords, each of which has two ends respectively connected to a clamp through which each of the cords can be removably attached to two of the string hooks which are located on the same short side of the supporting plane; and a belt which has two ends respectively connected to two swivel hooks; wherein each of the pair of cords can be removably attached and moveable relative to one of the swivel hooks so that the supporting plane can rotate relative to the belt between a stowed position and a deployed position.

2. The device of claim 1 further comprising four pieces of small fabric each of which is permanently connected to the supporting plane via a rivet, each of the string hooks is removably attached to one of the two ends of the two short sides via one piece of the fabric.

3. The desk of claim 1 wherein the supporting plane can rotate approximately 180 degrees relative to the belt from a vertical position to a horizontal position in order to conveniently suit for the position that the user take.

4. The device of claim 1 further comprising a component to prevent the supporting plane from tilting forward to get out of orientation.

5. The device of claim 1 further comprising at least one neck pad which is locked onto the belt around users' neck area to make the users comfortable when wearing the device.

6. The device of claim 1 further comprising an adapter attached to the belt so that the height of the rectangular plane can be adjusted to a conveniently suitable position that the user take.

7. The device of claim 1, further comprising a plurality of retainers for securing an mobile device or legal pad.

8. The device of claim 1, wherein the supporting plane is preferably rectangular in shape.

9. The device of claim 8 wherein the supporting plane is made of two halves which are connected to each other via a hinge running parallel with the short sides of the supporting plane such that the two halves are foldable over each other and can be unfolded when in use in order to provide a larger supporting surface and may be folded when in a stowed position in order to reduce the size for easy carrying.

10. The device of claim 1 further comprising a plurality of clips attached to the underneath of the supporting plane to hold a legal pad.

* * * * *